United States Patent [19]

Serin

[11] Patent Number: 4,915,388

[45] Date of Patent: Apr. 10, 1990

[54] GOLF TRAINING APPARATUS

[76] Inventor: Frédéric Serin, 7, rue Bridaine, 75017 Paris, France

[21] Appl. No.: 193,651

[22] PCT Filed: Nov. 19, 1986

[86] PCT No.: PCT/FR86/00393

§ 371 Date: Mar. 31, 1988

§ 102(e) Date: Mar. 31, 1988

[87] PCT Pub. No.: WO88/00851

PCT Pub. Date: Feb. 11, 1988

[30] Foreign Application Priority Data

Aug. 5, 1986 [FR] France ..... 86 11339

[51] Int. Cl.[4] ..... A63B 69/36

[52] U.S. Cl. ..... 273/196; 273/200 R

[58] Field of Search ..... 273/196, 200 R, 200 A, 273/200 B, 26 E, 413; 248/575; 226/186; 272/133, 54 R, 54 A

[56] References Cited

U.S. PATENT DOCUMENTS

| | | | |
|---|---|---|---|
| 1,419,636 | 6/1922 | MacDonald | 273/196 |
| 1,761,039 | 6/1930 | Hazeltine . | |
| 2,721,650 | 10/1955 | Cummings et al. | 226/186 |
| 2,937,875 | 5/1960 | Mason . | |
| 3,561,658 | 2/1971 | McDermott | 226/186 |
| 3,892,412 | 7/1975 | Koo . | |
| 3,936,055 | 2/1976 | Scott | 273/176 H |
| 4,125,230 | 11/1978 | Fischer . | |
| 4,489,941 | 12/1984 | Shieh . | |

*Primary Examiner*—Edward M. Coven
*Assistant Examiner*—Valerie Szczepanik
*Attorney, Agent, or Firm*—McAulay Fisher Nissen & Goldberg

[57] ABSTRACT

Golf training apparatus, comprising a substantially rectangular casing adapted for placement onto the ground, and having an upper face provided with an opening through which passes a cable fixed to a golf ball adapted to be placed onto the upper surface of the casing for hitting by a player; a cable return mechanism for the cable disposed inside the casing, including at least one electric motor driving the cable, the cable return mechanism permitting the free unrolling of the cable when the ball is hit by the player; an actuator for coupling a power supply to the electric motor for control thereof the upper face including a plate associated with the actuator mechanism actuatable by a player; a magazine housed within the casing for housing the cable in a random fashion; and the plate controlling the actuator for pulling the cable back into the magazine for housing therein in a random manner with the cable being accumulated by freely coiling up onto itself, in a random manner, when the player presses the upper face and said actuator.

27 Claims, 3 Drawing Sheets

GOLF TRAINING APPARATUS

The present invention relates to a golf training apparatus.

Golf training apparatus are already known which enable a player to practice the different moves of golf such as the swing for long shots and approach shots, or putting for the small final strokes. Such apparatus are described for example in U.S. Pats. 1 761 039, 3 892 412, 3 936 055 and 4 222 568. Another known apparatus, which is described in U.S. Pat. 4 125 230, is equipped with means for automatically returning a golf ball to the starting position. This apparatus comprises, under an upper plate constituting a throwing base for the ball, a mechanism with an electric motor and a drum for winding a cable of which the free end is tied to the ball. The ball returning mechanism which is described in this patent, is particularly complicated, hence expensive and subject to breakdowns. In addition, the apparatus equipped with such a mechanism can only be used for practicing the swing and is not readily adaptable to putting practice.

It is the object of the present invention to overcome these drawbacks by proposing an apparatus of particularly simple design, requiring little maintenance, of low cost and permitting golf training in the best conditions.

To this effect, said golf training apparatus which comprises a substantially rectangular casing of reduced thickness, which rests on the ground and of which the upper face is provided with an opening through which passes a cable fixed to a golf ball which can rest on the upper face of the casing in order to be hit by the player, and, inside the casing, a mechanism driven by an electric motor for returning the cable and storing it in accumulated form, by actuating a switch controlling the power supply to the electric motor, which switch is actuatable by the player, is characterized in that the cable returning mechanism comprises means for allowing the free unrolling of the cable backwardly when the latter is pulled forward by the ball hit by the player, and on the contrary for forcing the cable forwardly, in the direction of a magazine housed in the casing and inside which the cable is stored by freely coiling up on itself, at random, when the player presses the switch.

The following is a description given by way of example and non-restrictively of one embodiment of the present invention with reference to the accompanying drawings, in which.

Figure 1:
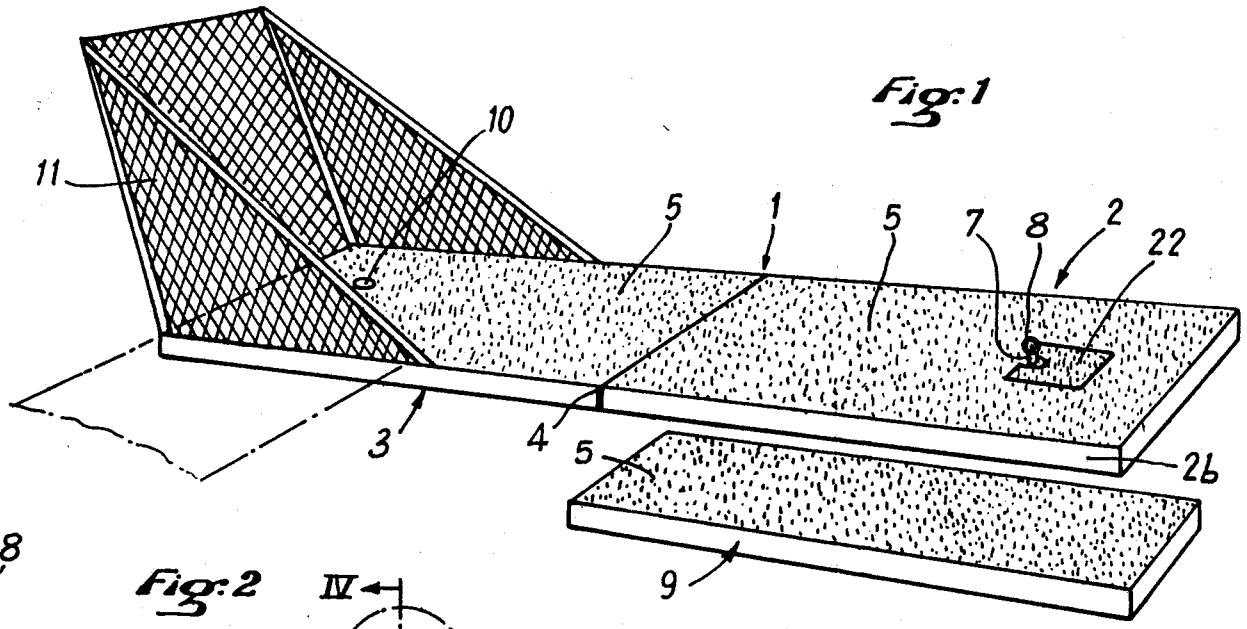
FIG. 1 is a perspective view of a golf training apparatus according to the invention.

The golf training apparatus according to the invention comprises a casing 1 for practicing long and short shots. Said casing 1, of rectangular shape, is constituted of two parallelepipedal parts, a front part 2 and a rear part 3 of identical dimensions, which are articulated, along two small adjacent sides, about a transversal hinge 4. The two articulated parts 2 and 3 of the casing 1 are, advantageously, entirely or partly covered with a layer of synthetic turf applied on their upper horizontal faces, when the casing is opened out and the two parts 2 and 3 are in horizontal alignment with each other on the ground, said two faces being brought into contact one over the other when the casing 1 is folded over. The front part 2 carries a tee 7, constituted by a length of tube, rising vertically above the upper face **2*a* of said part, on which tee a golf ball 8 can be placed in such a way as to be in a raised position with respect to the upper face 2*a* of the front part 2** of the casing.

The apparatus according to the invention further comprises a stepping board 9 which is necessary for the player to be situated at the right height with respect to the ball 8. The stepping board 9, has the same thickness as the main casing 1 and, is in the form of a parallelepipedal tray which is also advantageously covered on its upper face with a layer 5 of synthetic grass. Said stepping board 9 can advantageously be housed inside the rear part 3 of the casing 1, when said casing is folded into its closed position.

The rear part 3 of the casing 1 is provided in its upper face **3*a*, with a hole 10 permitting the practice of putting as described hereinafter. Moreover, a protecting net 11 is fixed to the rear part 3, said net extending upwardly, from the longitudinal sides and on the rear transverse side of the rear part 3. For transport, net 11 can advantageously be folded inside the casing 1**.

Figure 2:
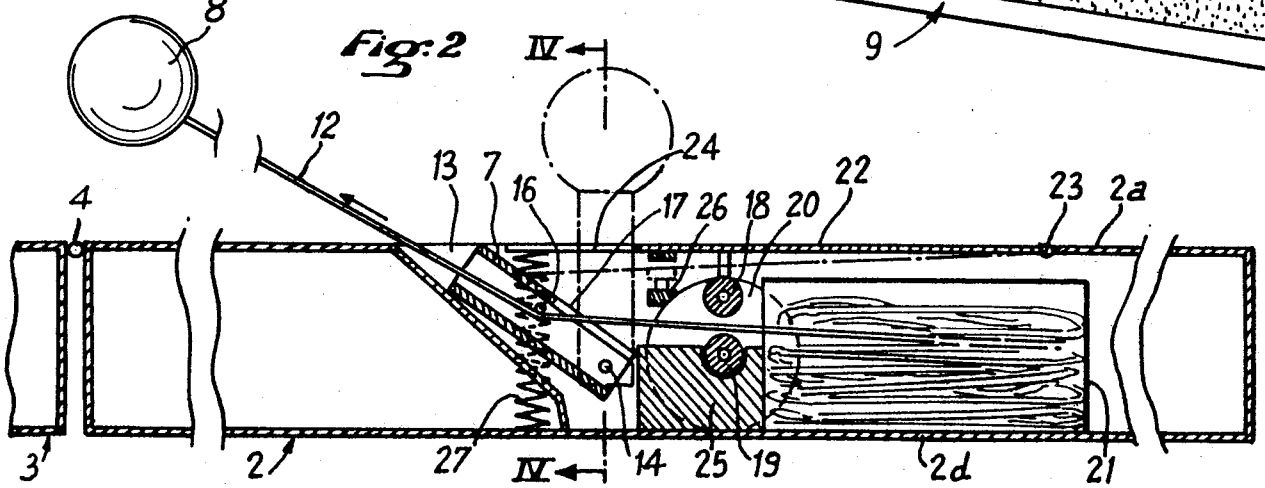
FIG. 2 is a vertical and longitudinal cross-section, on an enlarged scale, of the mechanism for returning the golf ball on the tee, with a view to performing a swing.
Figure 3:
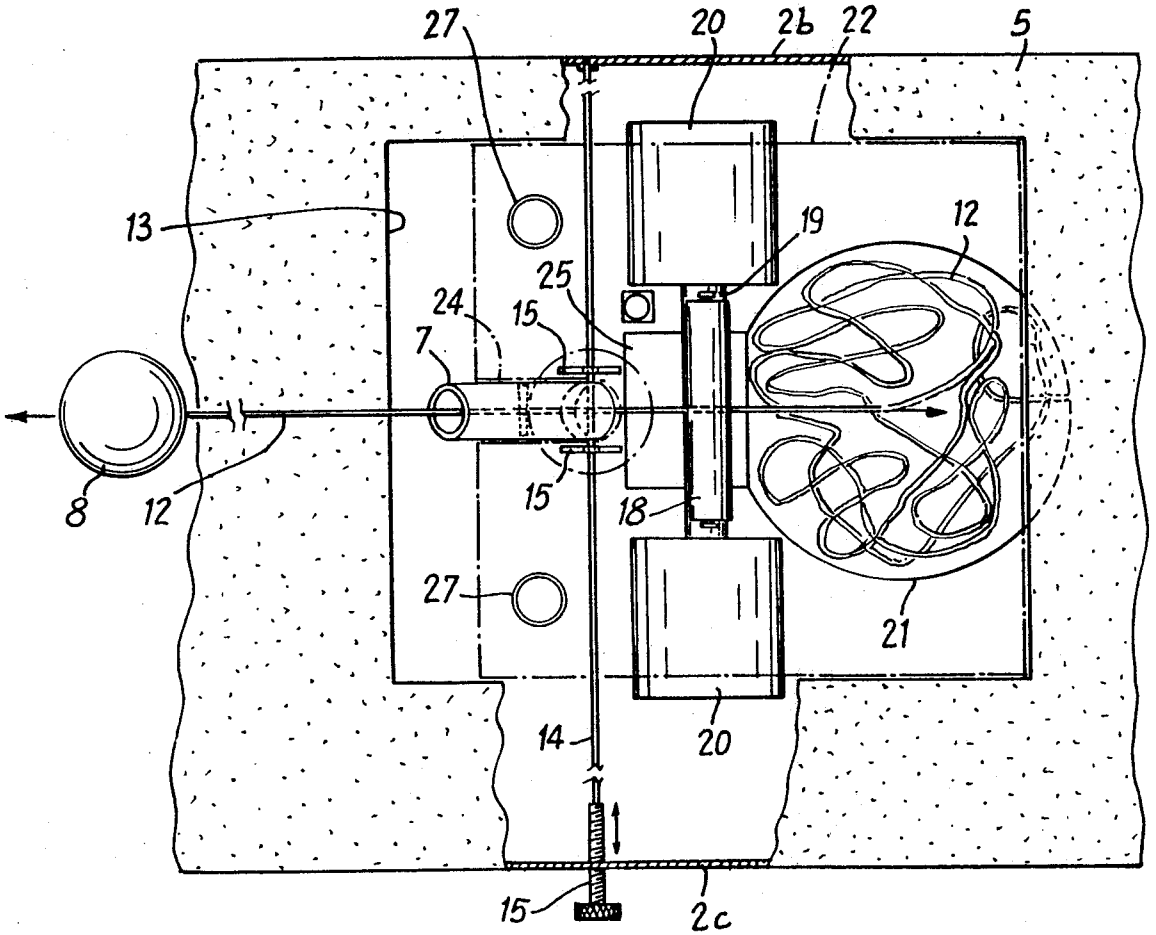
FIG. 3 is a plan view of the mechanism for returning the golf ball illustrated in FIG. 2.
Figure 5:
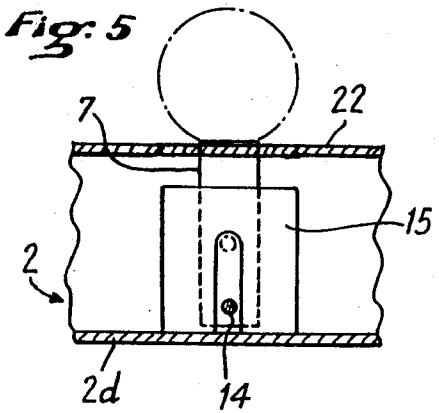
FIG. 5 is a view showing a partial vertical and longitudinal section along line V—V of FIG. 4.
Figure 4:
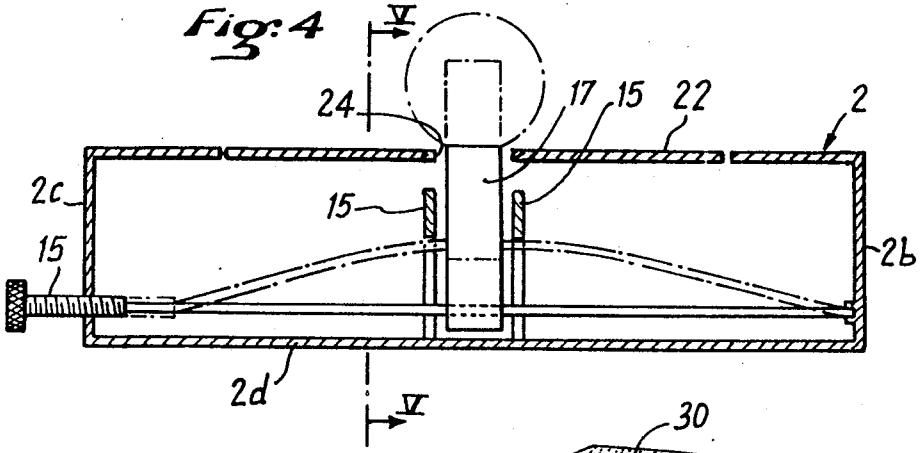
FIG. 4 is a cross-sectional view taken along line IV—IV of FIG. 2.

The front part 2 of the casing contains a mechanism which, after a swing shot, returns the ball 8 to the starting position. This mechanism comprises a cable 12 which is tied to the ball 8 and which extends through an opening 13 provided in the upper face **2*a* of the front part 2 of the casing. As can be seen in FIGS. 2 and 3, the tee 7 is articulated, at its lower part, about a horizontal and transverse axis 14. Said axis 14 is advantageously constituted by a metal rod traversing the tubular tee 7 through, extending transversely between a lateral and longitudinal wall 2*b* of part 2 of the casing and the front face of a transverse screw 15' on which it is in resting contact, said screw 15 being screwed in the other lateral and longitudinal wall 2*c* of part 2 of the casing. The rod 14 traverses vertical slots in two longitudinal guiding pieces 15 shaped as an upturned U, which pieces are fixed to the bottom 2*d* of the front part 2, on either side of the tee 7. It is thus possible, by screwing the screw 15 to a more or less extent, to deform the metallic rod 14 between a rectilinear horizontal position as illustrated in solid lines in FIG. 4, in which the pivoting axis of the tee 7 is in the lowest position, and a maximum bent position, illustrated in dot-dash lines, in which, due to the buckling of the rod 14, the tee 7** occupies the highest position. Conceivably, other equivalent means could be used for varying the vertical position of the tee.

As illustrated in FIG. 2, when the ball 8 has been thrown rearwardly, the cable 12 extends, starting from the ball 8, in a longitudinal direction through th tubular tee 7, it passes under a transverse bearing pin 16 situated about half-way along the tubular tee 7 and above the pivoting axis 14 of said tubular tee 7, and emerges thereform through a longitudinal slot 17 which is provided in the lower front part of the tubular tee 7 and spreads through to its lower end. From there, the cable 12 passes between an upper back-pressure cylinder 18 and a lower driving cylinder 19, both cylinders being placed one above the other and each one having a horizontal transverse axis. The lower driving cylinder 19 is coupled to the output shaft of at least one driving motor 20 (in this case, two motors 20 situated in opposite relation as illustrated). The cable 12 then penetrates into a storage magazine 21 inside which it is coiled up at random and it is fixed at its end. The upper back-pressure cylinder 18 is fixed under a rectangular movable plate 22 which extends in a part of the opening 13 provided in the upper horizontal face 2a of the front part 2 of the casing 1. Said movable plate 22 extends only over part of the length of said opening 13, so as to leave at the back, a free space for the passage of the cable 12 when the ball 8 is thrown in the direction of the net 11 as will be seen hereinafter. The movable plate 22 is articulated along its front edge, on the upper face 2a of part 2 of the casing 1, via a transverse hinge 23, thus forming a pedal member on which the player can rest. It is provided, in its rear part, with a longitudinal notch 24 which issues in its rear edge and which is wide enough to allow the passage therethrough of the tubular tee 7 when said tee is brought to its vertical position as illustrated in dot-dash lines in FIG. 2.

Preferably, a protecting cradle 25 is placed just below the lower driving cylinder 19, over most of the length thereof, to prevent the cable 12 from winding around the lower driving cylinder 19.

Under the movable plate 22 there is provided a switch 26 which controls the power supply to the electric motor or motors 20. Moreover, said movable plate 22 is held normally in a horizontal position, as illustrated in FIG. 2, by means of springs 27 resting on the bottom 2d of part 2 of the casing and under the plate 22. In the horizontal position, the movable plate 22 is thus flush with the rest of the upper face 2a of part 2 of the casing.

In order to perform a swing, the player places the ball 8 on the upper end of the tubular tee 7 which is then in a vertical position, as illustrated in dot-dash lines in FIG. 2. Said position can be adjusted heightwise by actuating the screw 15 controlling the bending of rod 14. When the player hits the ball 8 with his club, said ball 8 is thrown rearwardly in the direction of the net 11 driving or drawing with it the cable 12 to which it is tied. This movement causes the tubular tee 7 to pivot anti-clockwise under the action of the cable 12 which is pulled backwards by the ball 8, i.e. toward the left in FIG. 2, and which is unrolled from the reserve of cable contained in the storage magazine 21, and this freely due to the fact that the upper back-pressure cylinder 18 is moved away from the lower driving cylinder 19. The ball 8 is stopped in its stroke by the net 11 and falls on the upper face 3a of the rear part 3 of the casing 1.

In order to return the ball 8 to the starting position, the player only needs to press with his foot on the movable plate 22 so as to pivot it downwards, towards the position illustrated in dot-dash lines in FIG. 2. This pivoting movement causes the actuating of switch 26 and consequently the starting of the electric motor or motors 20. The lower driving cylinder 19 is then driven in clockwise rotation whereas the upper back-pressure cylinder 18 is pressed against it as a result of the fact that said cylinder 18 follows the movement of plate 22. The back-pressure cylinder 18 being mounted for free rotation about its axis, the result is that the cable 12 is pulled in forward direction, i.e. towards the right in FIG. 2, said cable being pinched between the two rollers 18 and 19. The part of cable 12 situated downstream of the two cylinders 18, 19, is thus driven back and forced to penetrate into the storage magazine 21 in which the cable coils up on itself in a totally randomly manner. When the ball 8 comes into contact with the upper end of the tubular tee 7, the cable is prevented from sliding with respect to said tubular tee 7 and the pulling force exerted on cable 12 causes, due to the fact that the bearing pin 16 is situated above the pivoting axis 14, a clockwise pivoting movement of the tubular tee 7 and of the ball that it carries, bringing them into a vertical starting position. During this movement, the upper part of the tubular tee 7 engages into the notch 24 provided in the rear part of the plate 22.

Figure 6:
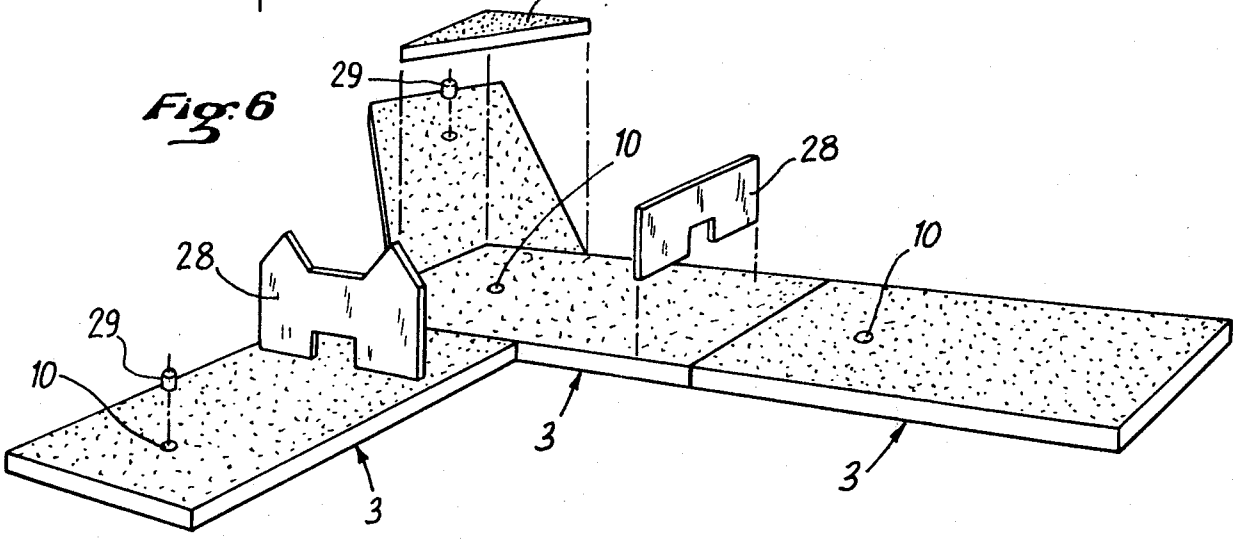
FIG. 6 is a perspective view of the apparatus adapted for putting practice.

FIG. 6 illustrates the way to adapt the apparatus according to the invention for putting practise. In this case, only the rear part 3 of the casing 1, which is provided with the hole 10, is used and said part 3 is used with other similar rectangular casings 3, each one of which is also provided with such a hole 10, said casings extending perpendicularly either to a small side or to a large side of the rear part 3. Obstacles 28 can be fixed in suitable areas of the casings surfaces, in order to enable the player to choose, at discretion, the difficulty of his course. Removable caps 29 can be used at discretion for blocking some of the holes.

The apparatus according to the invention can also comprise a movable part 30 of triangular shape for joining two adjacent casings according to any angle, so as to constitute a course of some kind.

I claim:

1. Golf training apparatus, comprising:

a substantially rectangular casing adapted for placement onto the ground, said casing having an upper face provided with an opening through which passes a cable fixed to a golf ball adapted to be placed onto the upper surface of said casing for hitting by a player;

a cable return mechanism for said cable disposed inside said casing, including at least one electric motor driving said cable, said cable return mechanism returning the cable for storing it in an accumulated form, said mechanism for returning the cable comprising means to permit the free unrolling of the cable when the ball is hit by the player, and a pair of parallel cylinders between which said cable passes, one of said cylinders being a lower driving cylinder having a fixed position and being coupled to said electric motor, and the other of said cylinders being an upper back-pressure cylinder with a movable position for movably clamping said cable therebetween in one position of said upper cylinder and for permitting free movement of said cable between said cylinder on another position of said upper cylinder;

an actuator for coupling a power supply to said electric motor for control thereof, said upper face including plate means associated with said actuator mechanism actuatable by a player;

a magazine housed within said casing for housing said cable in a random fashion;

a cable return means responsive to said plate means and said actuator for pulling the cable back into said magazine for housing therein in a random manner, said cable being accumulated by freely coiling up onto itself, in a random manner, when the player presses said upper face and said actuator, said plate means including a movable plate forming a pedal actuatable by the player, said plate being movably mounted in an opening of said horizontal upper face of the casing and carrying under it said back-pressure cylinder mounted above said driving cylinder;

a spring urging said movable plate upwardly for keeping said two cylinders apart from each other and to leave the cable free between them; and said activator being placed under said movable plate for actuation when the player presses on said plate forming said pedal.

2. Apparatus according to claim 1, having a tubular tee comprising a length of tube, articulated at its lower part about a horizontal and transverse axis;

said tubular tee being positioned to the rear of and on one side of said two cylinders and remote from said storage magazine for said cable, said storage magazine being positioned on the other side of said two cylinders; and said cable extending out of said magazine between said cylinder and longitudinally through said tubular tee and passing through an opening provided in the lower and front part of said tubular tee.

3. Apparatus according to claim 2, wherein said tubular tee has a pivoting axis and said cable rests under a transverse pin fixed inside said tubular tee above said pivoting axis.

4. Apparatus according to claim 2, wherein said plate partially covers said opening and is articulated by means of a transverse hinge along one edge thereof; said plate being provided along the other edge thereof with a longitudinal notch large enough to allow the pivotal movement of said tubular tee.

5. Apparatus according to claim 2, including a protecting cradle positioned below said lower driving cylinder over most of the length thereof, for preventing said cable from winding itself around said lower driving cylinder.

6. Apparatus according to claim 2, including means for varying the height of the pivoting axis of said tubular tee.

7. Apparatus according to claim 6, wherein said pivoting axis of said tubular tee comprises a metal rod extending between two side walls of the casing and passing through said tee, said rod being connected to a screw held in one side wall, so that by turning said screw, said metal rod is deformed between a horizontal rectilinear position in which said pivoting axis is in its lowest position, and a maximum bent position in which, as a result of the buckling of the rod, said tee occupying the highest position.

8. Apparatus according to claim 1, wherein the casing comprises:

a parallelipipedal casing having two parts articulated one to the other and folded one over the other about a transverse hinge extending along two small adjacent sides;

one part of said casing forming a front part containing said return mechanism for said cable and the other part of said casing having the same thickness as said one part and carrying a spreadable protecting net and carries a stepping board having the same thickness as said two parts adapted placement by the side of said front part for practicing swing strokes.

9. Apparatus according to claim 8, wherein said casing includes a rear part provided in its upper face thereof with a putting hole;

additional rectangular casings similar to said rear part being joined thereto;

each of said additional rectangular casings being provided with a hole; and each of said additional casings extending towards one of the sides of said rear part in an angular relationship thereto to provide any type of course.

10. Golf training apparatus, comprising:

a parallelepipedal casing having two parts articulated one to the other and folded one over the other about a transverse hinge extending along two small adjacent sides, said one part of said casing being adapted for placement onto the ground and having an upper face provided with an opening through which a cable fixed to a golf ball passes adapted for placement thereof onto the upper surface of said casing for hitting by a player;

a cable return mechanism for said cable disposed inside said casing;

at least one electric motor for driving said cable;

a cable return mechanism for returning said cable and storing thereof in an accumulated form in a magazine housing in said casing;

said casing having one part containing said return mechanism and another part carrying a spreadable protecting net;

an actuator coupling a power supply to said electric motor for control thereof and associated with an upper face of said casing is an actuating means for actuating said actuator by a player;

said cable return mechanism comprising free unrolling means to permit the free unrolling of said cable when the ball is hit by the player; and cable return means to pull the cable back into said magazine housed within said casing, said cable being accumulated by freely coiling up onto itself, in a random manner, when the player presses said upper face and said actuator.

11. Apparatus according to claim 10, including a stepping board having the same thickness as said casing, said stepping board being adapted to be placed by the side of said casing for practicing swing strokes.

12. Apparatus according to claim 10, wherein said cable returning mechanism comprises:

a pair of parallel cylinders between which said cable passes, one of said cylinders being a lower driving cylinder having a fixed position and being coupled to said electric motor, and the other of said cylinders having a movable position and being an upper back-pressure cylinder;

said actuatable means including a plate forming a pedal actuatable by the player, said plate being movably mounted in an opening of said horizontal upper face of said casing and carrying under it said back-pressure cylinder mounted above said driving cylinder;

a spring urging said movable plate upwardly for keeping said two cylinders apart from each other and to leave the cable free between them; and said actuator being placed under said movable plate for actuation when the player presses said pedal.

13. Apparatus according to claim 12, including a tubular tee comprising a length of tube, articulated at its lower part about a horizontal and transverse axis;

said tubular tee being positioned behind said two cylinders forming part of said return mechanism and remote from said storage magazine; and said cable extending longitudinally through said tubular tee and passing through an opening provided in the lower and front part of said tubular tee.

14. Apparatus according to claim 13, wherein said cable rests under a transverse pin fixed inside said tubular tee above said pivoting axis.

15. Apparatus according to claim 13, wherein said plate partially covers said opening and is articulated along one edge via a transverse hinge, said plate being provided along the other edge with a longitudinal notch large enough to allow the pivotal movement of said tubular tee.

16. Apparatus according to claim 13, including a protecting cradle positioned below said lower driving cylinder over most of the length thereof, for preventing said cable from winding itself around said lower driving cylinder.

17. Apparatus according to claim 13, including means for varying the height of the pivoting axis of said tubular tee.

18. Apparatus according to claim 17, wherein said pivoting axis of said tubular tee comprises a metal rod extending between two side walls of said casing and passing through said tee, said rod being connected to a screw which is held in one side wall for deforming, by turning said screw, said metal rod between a horizontal rectilinear position in which said pivoting axis is in its lowest position, and a maximum bent position in which, as a result of the buckling of the rod, said tee occupying the highest position.

19. Golf training apparatus, comprising:

a parallelepipedal casing having two parts articulated one to the other and folded one over the other about a transverse hinge extending along two small adjacent sides, one of said parts of said casing being adapted for placement onto the ground and having an upper face provided with an opening through which a cable fixed to a golf ball passes adapted for placement thereof onto the upper surface of said casing for hitting by a player, the other of said parts of said casing being a rear part provided in its upper face thereof with a putting hole;

a cable return mechanism for said cable disposed inside said casing;

at least one electric motor for driving said cable;

a cable return mechanism for returning said cable and storing thereof in an accumulated form in a magazine housing in said casing;

an actuator coupling a power supply to said electric motor for control thereof and associated with an upper face of said casing is an actuating means for actuating said actuator by a player;

said cable return mechanism comprising free unrolling means to permit the free unrolling of said cable when the ball is hit by the player;

cable return means to pull the cable back into said magazine housed within said casing, said cable being accumulated by freely coiling up onto itself, in random manner, when the player presses said upper face and said actuator;

additional rectangular casings similar to said rear part being associated therewith, each of said additional rectangular casings being provided with a hole;

each of said additional casings extending towards one of the sides of said rear part in an angular relationship thereto to provide different types of courses;

a stepping board having the same thickness as said casing, said stepping board being adapted to be placed by the side of said casing for practicing swing strokes.

20. Apparatus as claimed in claim 19, wherein said casing includes one part of said casing containing said return mechanism and another part carrying a spreadable protecting net.

21. Apparatus according to claim 20, wherein said cable returning mechanism comprises:

a pair of parallel cylinders between which said cable passes, one of said cylinders being a lower driving cylinder having a fixed position and being coupled to said electric motor, and the other of said cylinders having a movable position and being an upper back-pressure cylinder;

said actuatable means including a plate forming a pedal actuatable by the player, said plate being movably mounted in an opening of said horizontal upper face of said casing and carrying under it said back-pressure cylinder mounted above said driving cylinder;

a spring urging said movable plate upwardly for keeping said two cylinders apart from each other and to leave the cable free between them; and said actuator being placed under said movable plate for actuation when the player presses said pedal.

22. Apparatus according to claim 21, including:

a tubular tee comprising a length of tube, articulated at its lower part about a horizontal and transverse axis;

said tubular tee being positioned behind said two cylinders forming part of said return mechanism and remote from said storage magazine; and said cable extending longitudinally through said tubular tee and passing through an opening provided in the lower and front part of said tubular tee.

23. Apparatus according to claim 22, wherein said cable rests under a transverse pin fixed inside said tubular tee above said pivoting axis.

24. Apparatus according to claim 22, wherein said plate partially covers said opening and is articulated along one edge via a transverse hinge, said plate being provided along the other edge with a longitudinal notch large enough to allow the pivotal movement of said tubular tee.

25. Apparatus according to claim 22, including a protecting cradle positioned below said lower driving cylinder over most of the length thereof, for preventing said cable from winding itself around said lower driving cylinder.

26. Apparatus according to claim 22, including means for varying the height of the pivoting axis of said tubular tee, said pivoting axis of said tubular tee comprising a metal rod extending between two side walls of said casing and passing through said tee, said rod being connected to a screw which is held in one side wall for deforming, by turning said screw, said metal rod between a horizontal rectilinear position in which said pivoting axis is in its lowest position, and a maximum bent position in which, as a result of the buckling of the rod, said tee occupying the highest position.

27. Apparatus according to claim 19, including a movable part for joining two adjacent casings at any angle to form a course.

* * * * *